US011001489B2

(12) United States Patent
Herlin

(10) Patent No.: US 11,001,489 B2
(45) Date of Patent: *May 11, 2021

(54) METHOD FOR MONITORING BEER KEGS

(71) Applicant: Gregory W Herlin, Kirkland, WA (US)

(72) Inventor: Gregory W Herlin, Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/526,414

(22) Filed: Jul. 30, 2019

(65) Prior Publication Data

US 2019/0375624 A1 Dec. 12, 2019

Related U.S. Application Data

(63) Continuation of application No. 15/130,179, filed on Apr. 15, 2016, now Pat. No. 10,384,924.

(51) Int. Cl.
*G08B 23/00* (2006.01)
*B67D 1/08* (2006.01)

(52) U.S. Cl.
CPC ..... *B67D 1/0878* (2013.01); *B67D 1/0801* (2013.01); *B67D 1/0888* (2013.01); *B67D 2001/0811* (2013.01); *B67D 2001/0822* (2013.01)

(58) Field of Classification Search
CPC .. B67D 1/0878; B67D 1/0801; B67D 1/0888; B67D 2001/0811; B67D 2001/0822
See application file for complete search history.

(56) References Cited

U.S. PATENT DOCUMENTS

| | | | | |
|---|---|---|---|---|
| 9,485,549 | B2 * | 11/2016 | Hershberger | G06Q 30/0633 |
| 10,384,924 | B2 * | 8/2019 | Herlin | B67D 1/0878 |
| 10,633,239 | B2 * | 4/2020 | Herlin | B67D 1/0801 |
| 2012/0059513 | A1 * | 3/2012 | Perkins | B67D 1/0406 700/244 |
| 2013/0314244 | A1 * | 11/2013 | Hershberger | G06Q 30/0633 340/870.02 |

* cited by examiner

*Primary Examiner* — Dhaval V Patel
(74) *Attorney, Agent, or Firm* — Clark A. Puntigam; Jensen & Puntigam P.S.

(57) ABSTRACT

The method includes indentifying the beer keg to a brewery which fills the keg and for identifying the date on which the beer keg is filled. A sensor system is attachable to or built into the beer keg for identifying the temperature of the beer and for locating the keg. A communication system directly transmits information between the brewery and the sensor system on the keg.

5 Claims, 4 Drawing Sheets

METHOD FOR MONITORING BEER KEGS

TECHNICAL FIELD

This invention relates generally to beer kegs and more specifically to a system for monitoring one or more characteristics of the use and/or contents of beer kegs.

BACKGROUND OF THE INVENTION

Draft beer is typically provided in beer kegs, with the kegs having a typical volume in the range of 15.5 gallons. However, it has been difficult, if not impossible, heretofore, to ensure proper handling of draft beer kegs to ensure quality of the beer. Temperature, age and light are the highest risk factors that affect quality of draft beer. The lack of an ability to provide quality control and monitoring produces an economic loss to the owner. Estimates indicate that the lack of control over handling results in a 4-7%, or even more, reduction in sales. Poor handling includes exposure to even moderate heat as well as excessive time in storage, even storage which is temperature controlled. Further, even with refrigerated trains and trucks, there is no automated system to ensure overall proper handling of the individual kegs. While most kegs do a suitable job for protecting beer from the effects of light, other factors such as temperatures to which the keg has been exposed and age of the beer significantly affect the quality of the beer over its lifetime in a keg.

Once a filled beer keg leaves the producer, i.e. the brewer, there is no reliable way for the brewer to know the conditions the keg encounters, or whether it was ever subjected to conditions which could affect quality. Further, there is no verification of the travel of the individual beer keg and no knowledge of the location of a keg. Typically, many kegs go missing, and are never returned to the source. It has been estimated that in excess of 20 million kegs are used each year with 500.00 kegs lost and 100 million dollars in economic loss.

Accordingly, it would be desirable to have a monitoring system/method which can correct one or more of the disadvantages encountered by beer kegs during use thereof.

SUMMARY OF THE INVENTION

Accordingly, disclosed herein is a method for monitoring the use of beer kegs, and the status of beer contained therein, for a brewery having a source of beer, wherein the brewery in operation fills the kegs with beer and communicates directly with the kegs, the method comprising the steps of: providing a sensor system and attaching it to a beer keg; providing a two-way information communication link over a cellular network directly connecting the brewery and the sensor system on the keg concerning the status of the keg and the beer therein, including providing information to the brewery from the sensor system that the keg has arrived at the brewery for filling and confirming to the sensor system on the keg from the brewery that the arrived keg is ready to be filled with beer by the brewery following cleaning thereof by the brewery; filling the beer keg which has been cleaned and is otherwise ready to be filled with beer by the brewery; providing information to the sensor system on the keg by the brewery, including the date on which the keg has been filled with beer by the brewery; transporting the filled keg or alternatively, temporarily storing and transporting the filled keg thereafter, by the brewery to a destination; acquiring information by the sensor system concerning the temperature of the beer in the keg by a temperature sensor in the sensor system when movement of the filled keg occurs and providing an alert to the brewery over the cellular network when the temperature of the beer is out of a standard temperature range; acquiring location information of each keg individually by a location sensor in the sensor system as the keg moves from the brewery to its destination and providing the location information of the keg to the brewery; and wherein all information acquired by the sensor system is provided directly to the brewery over the cellular communication link and all information concerning the kegs by the brewery to the sensor system is provided directly over the cellular communication link.

BEST MODE FOR CARRYING OUT THE INVENTION

Figure 1:
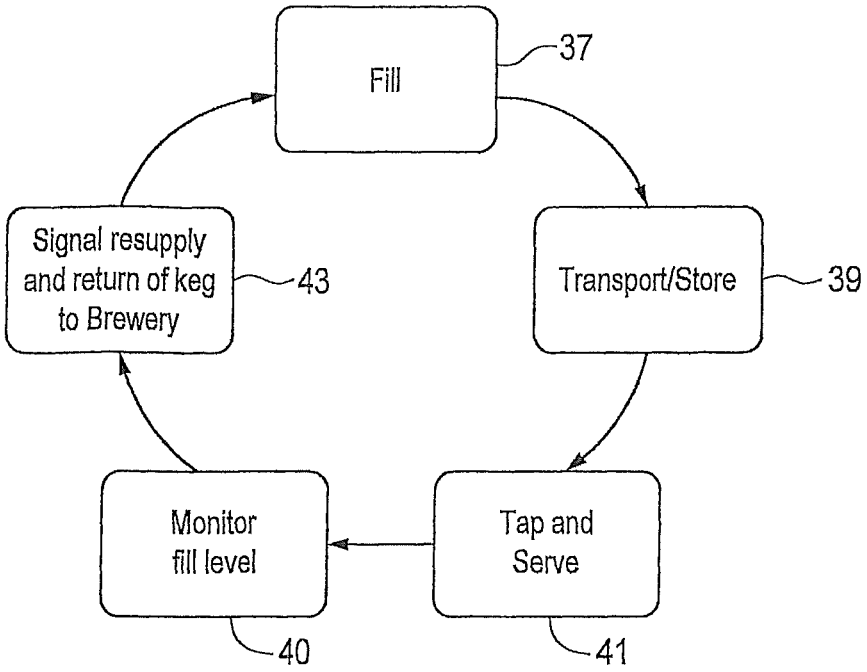
FIG. 1 is a block diagram showing the sequence of use of the present beer keg system.
Figure 2:
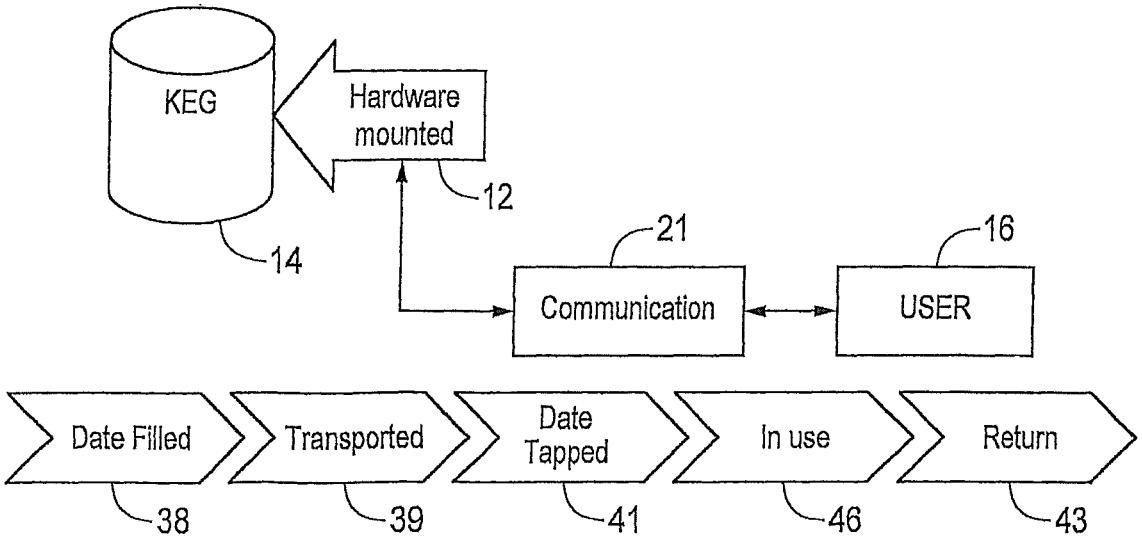
FIG. 2 is a more detailed diagram illustrating the hardware monitoring of the present system and the tracking of the life of a single filling of the beer keg.

Referring to FIGS. 1-5, the present system includes one or more sensors 12 attached to a beer keg 14 by a user/proprietor, typically a brewery or other organization which fills the keg with beer. The beer could be conventional, including well known beer brands, or what are known as craft beers, brewed in smaller quantities. The sensors will be part of a device 15, shown in FIG. 4 in combination with an external user data center 16, the device 15 including a communication capability, software and data storage 17, as well as a processor 19. FIGS. 5A and 5B show two embodiments for the monitoring device, one on top of the keg, at 13 adjacent the fill port 14A and the other along a portion of the periphery of the top of the keg, at 13. The processor will typically include a battery 20 and/or charging unit, (plug) 22. The user represented at 16 (FIG. 2) will initially signal the hardware sensors 12 that the beer keg 14 is clean and ready for filling. The user will have previously cleaned the keg and otherwise made it ready for filling. Communication can be accomplished via a wired or wireless connection 21 to the device. The assembly is turned on and remains on. Communication is established with the network. A systems check confirms that the sensors have power and sufficient charge to begin their monitoring function. A signal is sent back to the user 16 via the communication link 21. The sensors establish a current time and date, fill level, temperature, and the location of the keg. This information is recorded in temporary memory 17 in the device. The keg is identified by a serial number assigned to it. Communication is provided between a processor 19 and the sensors 12 and the external data center 30 via a communication link GSM (cellular) system 32, WIFI 34 or Bluetooth 36 or others. When the keg is indentified and acknowledged by the processor 19, the keg is filled, as indicated at 37. The date and time of filling is recorded, at 38. The filled keg is then stored and/or transported, at 39. The storage can be accomplished by various entities, including the brewery itself, a distributor or a retailer. Readings of time, temperature and location are then taken by the sensor unit at selected intervals, such as hourly, and recorded in temporary data storage 17. This, however, can vary. When the keg reaches its destination, it is tapped and the beer served, at 41, and in use, 46 from that point.

The processor and more particularly the software in the processor, checks regularly for receipt of data from the sensors, which will typically include temperature 45, fill level (volume) 47 and location 49. Typically, the sensor readings are recorded in the data storage 17 on an hourly basis but are then transmitted to the external data control center 30 daily, but this can be changed by the user. An alarm can be transmitted if no data is recorded by the data center. Alarms can be set for temperature variations from a standard temperature range during transport or use of the keg including over temperature and under temperature. It is important that the beer not be exposed to temperatures outside of the preselected range, which may vary depending on the beer. If data transmission is for some reason temporarily interrupted i.e. not fulfilling the daily reporting requirements, communication begins with the last confirmed communication, at least 24 hours of data. The location of the keg (longitude and latitude) can be provided as well. Location can be provided to the user at the data center on a map, for instance. Volume can be recorded by a flow sensor or force sensor, at the bottom of the keg, as shown at 48 in FIG. 5.

When the volume measured or determined from the force sensor reaches a certain low level, a notice can be sent to the user advising them of the volume remaining. The keg can then be retrieved or sent back to the user from the last location, to ensure freshness. Further, a resupply notice can be sent to the user providing an indication that a resupply is necessary. Contact can then be made with the proprietor or other user at the location relative to a providing new keg. The original keg is then returned to the brewery for cleaning and reuse, at 43.

Figure 3:
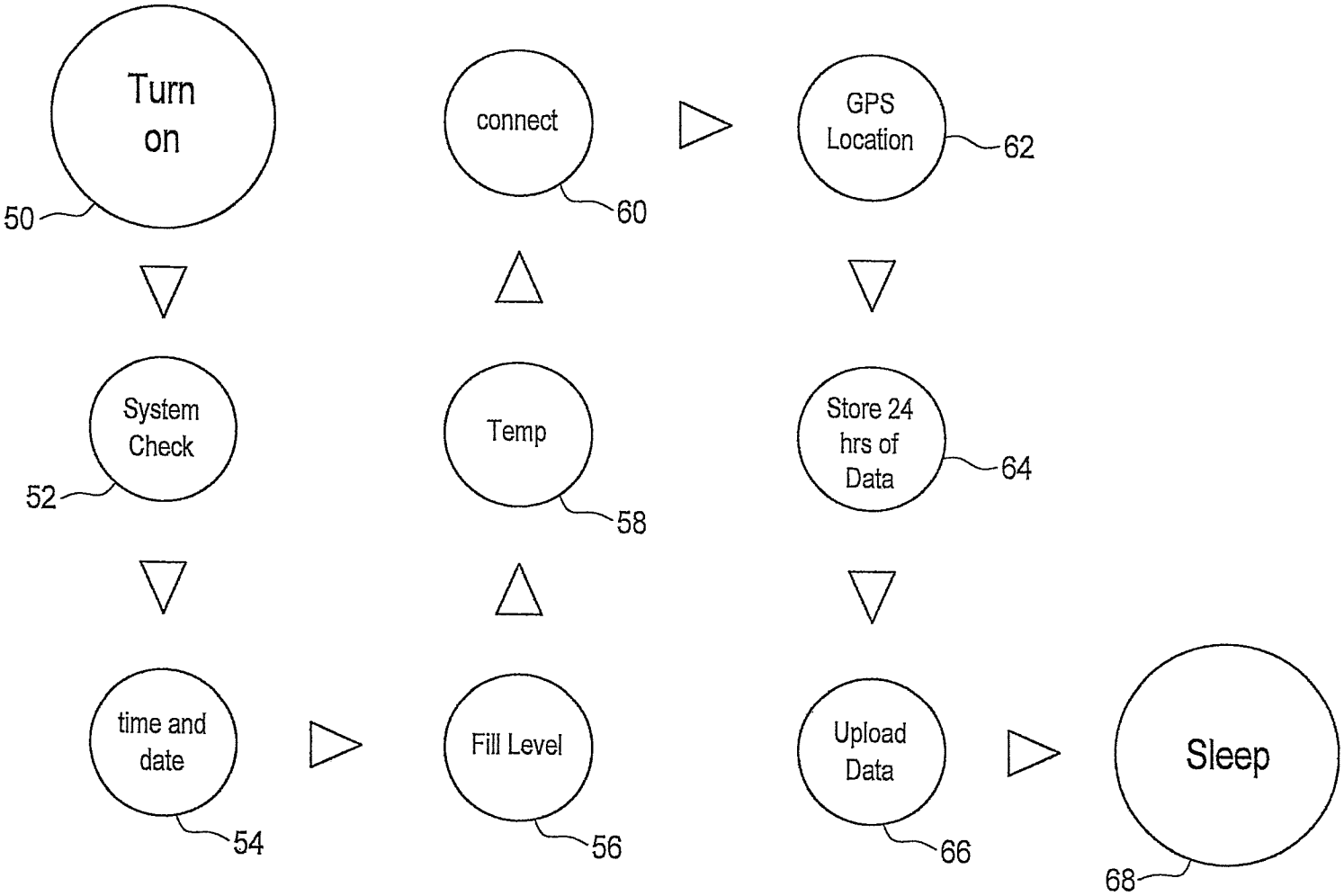
FIG. 3 is a diagram showing the flow of information from the hardware elements to the data collection and processing center.
Figure 4:
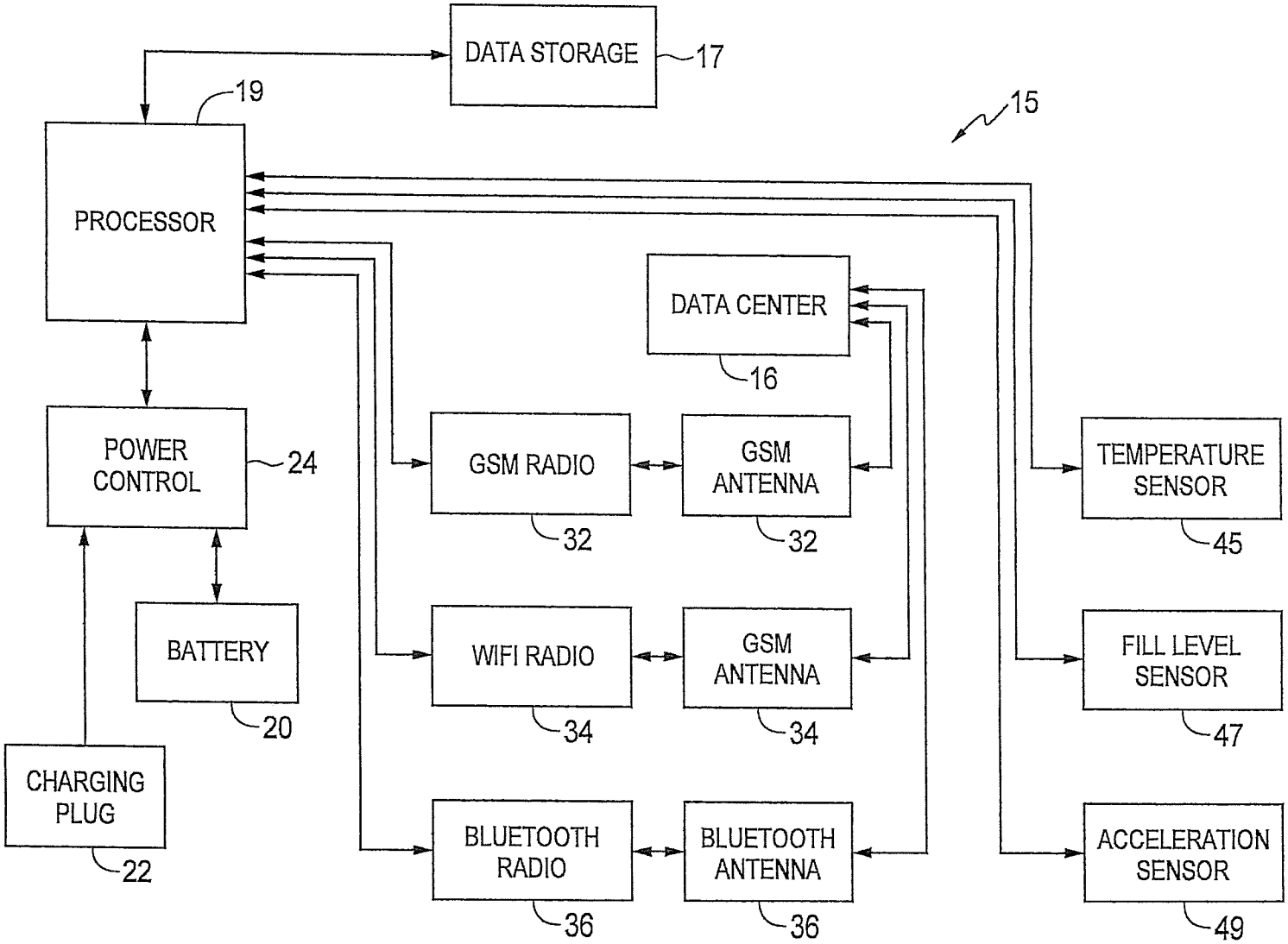
FIG. 4 is a block diagram showing the operating hardware of the present system.
Figure 5A:
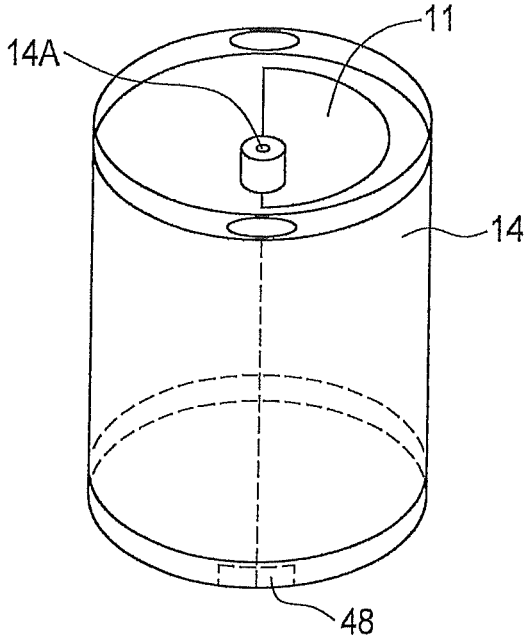
FIGS. 5A and 5B are more detailed views of the sensor/beer keg connection arrangement.
Figure 5B:
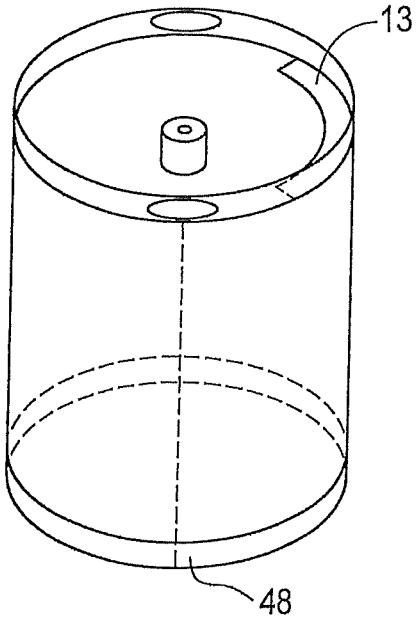

FIG. 3 shows the cycle of use of the present invention. The system is turned on, at 50, and remains on, and a system check preformed, at 52. The time and date of fill is recorded, at 54. The fill level and the temperature are constantly monitored, at 56 and 58, and connection is made with the on-keg processor, at 60, with GPS information at 62, and 24 hours of data stored, at 64. The data is then uploaded from temporary storage at 66 to the external data center. The system then goes into a sleep mode, at 68, until it is again time to take sensor readings, at intervals predetermined by the user.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A method for monitoring the use of beer kegs, and the status of beer contained therein, for a brewery having a source of beer, wherein the brewery in operation fills the kegs with beer and communicates directly with the kegs, the method comprising the steps of:

providing a sensor system and attaching it to a beer keg;

providing a two-way information communication link over a cellular network directly connecting the brewery and the sensor system on the keg concerning the status of the keg and the beer therein, including providing information to the brewery from the sensor system that the keg has arrived at the brewery for filling and confirming to the sensor system on the keg from the brewery that the arrived keg is ready to be filled with beer by the brewery following cleaning thereof by the brewery;

filling the beer keg which has been cleaned and is otherwise ready to be filled with beer by the brewery;

providing information to the sensor system on the keg by the brewery, including the date on which the keg has been filled with beer by the brewery;

transporting the filled keg or alternatively, temporarily storing and transporting the filled keg thereafter, by the brewery to a destination;

acquiring information by the sensor system concerning the temperature of the beer in the keg by a temperature sensor in the sensor system when movement of the filled keg occurs and providing an alert to the brewery over the cellular network when the temperature of the beer is out of a standard temperature range;

acquiring location information of each keg individually by a location sensor in the sensor system as the keg moves from the brewery to its destination and providing the location information of the keg to the brewery; and wherein all information acquired by the sensor system is provided directly to the brewery over the cellular communication link and all information concerning the kegs by the brewery to the sensor system is provided directly over the cellular communication link.

2. The method of claim 1, including the step for providing a notice of resupply to a party when the volume of beer in the keg has reached a selected level.

3. The method of claim 1, wherein the sensor system is located along a portion of a rim of the beer keg.

4. The method of claim 1, wherein a core force sensor is located at the bottom of the beer keg.

5. The method of claim 1, wherein location information provided to the brewery includes movement of the keg in the vicinity of the destination.

* * * * *